US008244588B1

(12) United States Patent
Ahmed

(10) Patent No.: US 8,244,588 B1
(45) Date of Patent: Aug. 14, 2012

(54) METHOD AND APPARATUS FOR ENTERING PURCHASE INFORMATION

(75) Inventor: Shahid Ahmed, Bangalore (IN)

(73) Assignee: Intuit Inc., Mountain View, CA (US)

( * ) Notice: Subject to any disclaimer, the term of this patent is extended or adjusted under 35 U.S.C. 154(b) by 1100 days.

(21) Appl. No.: 11/656,739

(22) Filed: Jan. 22, 2007

(51) Int. Cl.
*G06Q 30/00* (2006.01)

(52) U.S. Cl. ..... 705/26.1; 705/27.1; 382/174; 715/224

(58) Field of Classification Search ..... 705/26, 705/27, 26.1, 27.1; 715/224; 382/174
See application file for complete search history.

(56) References Cited

U.S. PATENT DOCUMENTS 6,411,313 B1 * 6/2002 Conlon et al. ..... 715/769
7,305,129 B2 * 12/2007 Chellapilla et al. ..... 382/174
7,496,832 B2 * 2/2009 Chen et al. ..... 715/222
2001/0023402 A1 * 9/2001 Flynn ..... 705/1
2003/0030672 A1 * 2/2003 Hughes et al. ..... 345/765
2004/0181749 A1 * 9/2004 Chellapilla et al. ..... 715/505
2004/0220964 A1 * 11/2004 Shiftan et al. ..... 707/103 R
2005/0131768 A1 * 6/2005 Rodriguez et al. ..... 705/26

OTHER PUBLICATIONS

"Not Exactly a Paperless Office, But Close," by Ted Needleman, Investor's Business Daily, Los Angeles: Dec. 4, 1998, p. A.1.*

* cited by examiner

*Primary Examiner* — Jeffrey A Smith
*Assistant Examiner* — Anne Georgalas
(74) *Attorney, Agent, or Firm* — Park, Vaughan, Fleming & Dowler LLP; Anthony P. Jones

(57) ABSTRACT

One embodiment of the present invention provides a system that enters purchase information into a software application. The system starts by accessing a file containing a receipt for a purchase. The system then extracts information relating to the purchase. Next, the system creates an entry for the purchase in a database for the software application. While creating the entry in the database, the system fills in a set of fields in the entry using the extracted information.

21 Claims, 3 Drawing Sheets

METHOD AND APPARATUS FOR ENTERING PURCHASE INFORMATION

BACKGROUND

Modern financial management applications provide automated features for tracking purchases. For example, given information about a user's past purchases, a typical financial management application can automatically generate simple information, such as a summary of purchases by the user, or complex information, such as categorizations of purchases or a projections of future expenses.

Unfortunately, users still manually perform many operations. For example, users often shop for inventory items and other goods by visiting online web stores. After making a purchase, user typically receives a receipt containing data relating to purchased items via email or a dedicated web page. The user must then manually enter this data into their financial management application by: (1) creating a purchase order for the purchased items; (2) adding information for new vendors (i.e., web stores) whose data does not exist within the financial management application; (3) adding information for new items whose data does not exist within the financial management application; (4) creating a bill, entering the items purchased into the bill, and saving the bill. Entering this data is a time-consuming and error-prone process.

SUMMARY

One embodiment of the present invention provides a system that enters purchase information into a software application. The system starts by accessing a file containing a receipt for a purchase. The system then extracts information relating to the purchase. Next, the system creates an entry for the purchase in a database for the software application. When creating the entry in the database, the system fills in a set of fields in the entry using the extracted information.

In a variation of this embodiment, extracting information involves running a browser within the software application, wherein the software application is signaled when the browser has accessed a web page that contains the receipt. Upon receiving the signal, the software application automatically extracts information relating to the purchase from the web page, wherein the software application uses a template to determine where information relating to the purchase is located on the web page.

In a variation of this embodiment, the system automatically updates the template by periodically downloading a current copy of the template from a host.

In a variation of this embodiment, extracting information involves running an extension of the software application within a second software application, wherein the extension is signaled when the second software application has accessed a file containing a receipt. Upon receiving the signal, the extension automatically extracts information relating to the purchase from the file containing the receipt, wherein the extension uses a template to determine where information relating to the purchase is located within the file containing the receipt.

In a further variation, the second software application is an email application or a browser.

In a variation of this embodiment, extracting the information involves extracting the information based on an indication received from a user specifying the location of the information within the file that contains the copy of the receipt.

In a variation of this embodiment, receiving the indication from the user involves the user dragging and dropping an indicator on information related to the purchase within a representation of the file that contains the receipt.

In a variation of this embodiment, the system modifies the extracted information according to a command from a user, wherein modifying the extracted information involves: changing information in, deleting information from, or adding information to, the extracted information.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the claims.

The data structures and code described in this detailed description are typically stored on a computer-readable storage medium, which may be any device or medium that can store code and/or data for use by a computer system. This includes, but is not limited to, magnetic and optical storage devices such as disk drives, magnetic tape, CDs (compact discs), DVDs (digital versatile discs or digital video discs), or any device capable of storing data usable by a computer system.

Computer System

Figure 1:
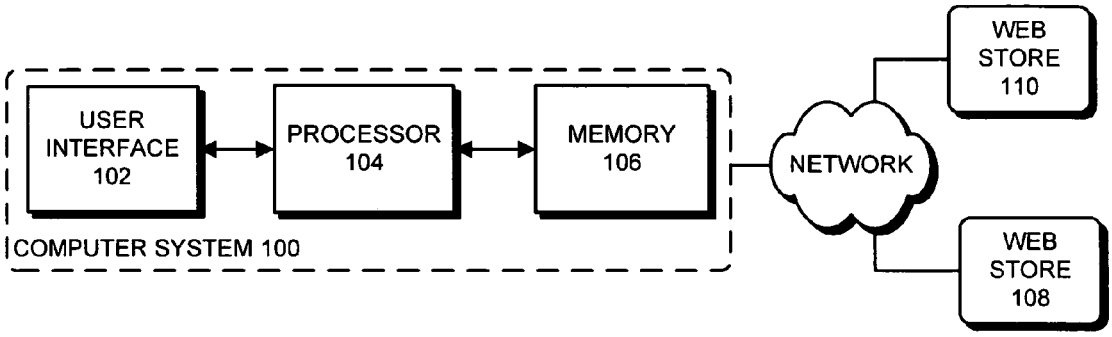
FIG. 1 illustrates a computer system in accordance with an embodiment of the present invention.

FIG. 1 illustrates a computer system 100 in accordance with an embodiment of the present invention. Computer system 100 includes user interface 102, processor 104, and memory 106. Processor 104 can be any type of microprocessor that executes program code. Memory 106 contains data and program code for processor 104. User interface 102 allows a user to communicate commands to, and to receive information from, computer system 100.

Computer system 100 is also coupled via a network to web stores 108 and 110. For example, a network can be the Internet, a local area network (LAN), a wide area network (WAN), a wireless network, or another type of coupling that allows computer system 100 to communicate with web stores 108 and 110. Web stores 108 and 110 are commercial websites that provide the user of computer system 100 with the ability to purchase items over the network. Typically, web stores 108 and 110 operate by: (1) allowing the web store visitors to select items for purchase; (2) displaying the items during checkout; (3) accepting payment via credit card (or other forms of payment); and (4) dispatching the billing information or a receipt to the customer via email or dedicated web page. The information displayed during checkout is typically in form of a table, which includes items and their quantities and prices.

In embodiments of the present invention, the user shops at a web store using a browser hosted within a financial management application, such as QuickBooks™, Quicken™, Money™, Small Business Accounting™, Gnucash™, or another application that facilitates the management of finances. In this way, the user can use the financial management application to shop from a web store. When the user is finished shopping in the web store, the web store displays a purchase receipt on a dedicated web page. The financial management application parses the receipt and does the following: (1) obtains information for any new vendors (web stores) whose data is not available in the financial management application; (2) obtains information for any new items whose data is not available in the financial management application; (3) creates a transaction which includes the items purchased; and (4) saves the created transaction. This approach saves the user from doing any data entry and dynamically creates a transaction in the financial management application's purchase information database.

In an alternative embodiment, the financial management application provides an extension (e.g., in the form of a software add-on or built-in functionality) that is used with a typical browser. Browsers that can be used in one or more embodiments of the present invention can include FireFox™, Internet Explorer™, Safari™, Opera™, or other browsers capable of displaying web pages in either a text-based format or a graphical format. In this embodiment, while browsing web pages on a network using the browser, the user is provided an interface (such as a toolbar or a command), that allows the user to indicate when a web page contains purchase information. When the user has indicated that the web page contains purchase information, the financial management application parses the web page and creates a transaction in the financial management application's purchase information database in the same way as the embodiment described in the preceding section.

Due to increased support for Simple Object Access Protocol (SOAP), as well as efforts to separate the data layer from the presentation layer within web stores using technologies such as Extensible Markup Language (XML) data files, and Extensible Stylesheet Language Transformations (XSLT), embodiments of the present invention read the list of items purchased over the web store from an underlying data file (such as an XML file) that has the table of items purchased through the web store. For example, consider the case where the user purchases some products from an online vendor, and the online vendor's e-commerce application has a strict separation between the data layer and the presentation layer. One embodiment of the present invention can obtain the list of items purchased, as well as all of the details about the items purchased, directly from the data file without having to deal with the transformation file or the resulting HTML file.

Parsing the Information Presented in a File

In one embodiment of the present invention, the financial management application parses a file containing purchase information. For example the financial management application can parse an HTML file, an email, a text file, a document file, or another type of file that has an identifiable format. In embodiments of the present invention, the financial management application uses Inline HTML (IHTML) Document Object Module (DOM) support to parse the file.

In embodiments of the present invention, the parser recognizes the format of the file. In other words, "data maps" are stored which are specific to the format of the file and which provide financial management application with information about what type of information is located at specific locations within the file (e.g.: in the table "billing info," all table nodes starting in row 2 for Amazon.com's purchase information web page have items purchased data and in each row, cell 1 contains "item name," cell 2 contains "item description," cell 3 contains "item price," and so on). Note that the financial management application can store a database which includes data maps that indicate how different web stores format purchase information (billing info). The financial management application can then use the data maps to parse the purchase information (number of items, store name, etc.) from the file accordingly.

When the data has been parsed, embodiments of the present invention present the user with the extracted data so that the user can make changes to the data before importing the data into the financial management application's purchase information database. For example, the user can modify inventory information if a different supplier names the same item differently or the user can modify vendor information.

In embodiments of the present invention, the financial management application includes an automatic updating function. Using the automatic updater, the financial management application stays current with software patches and other updates. In this embodiment, the company that created the financial management application monitors selected web sites for changes in the format of the purchase information web page and provides a current data map of the purchase information web pages via the updater.

Figure 2:
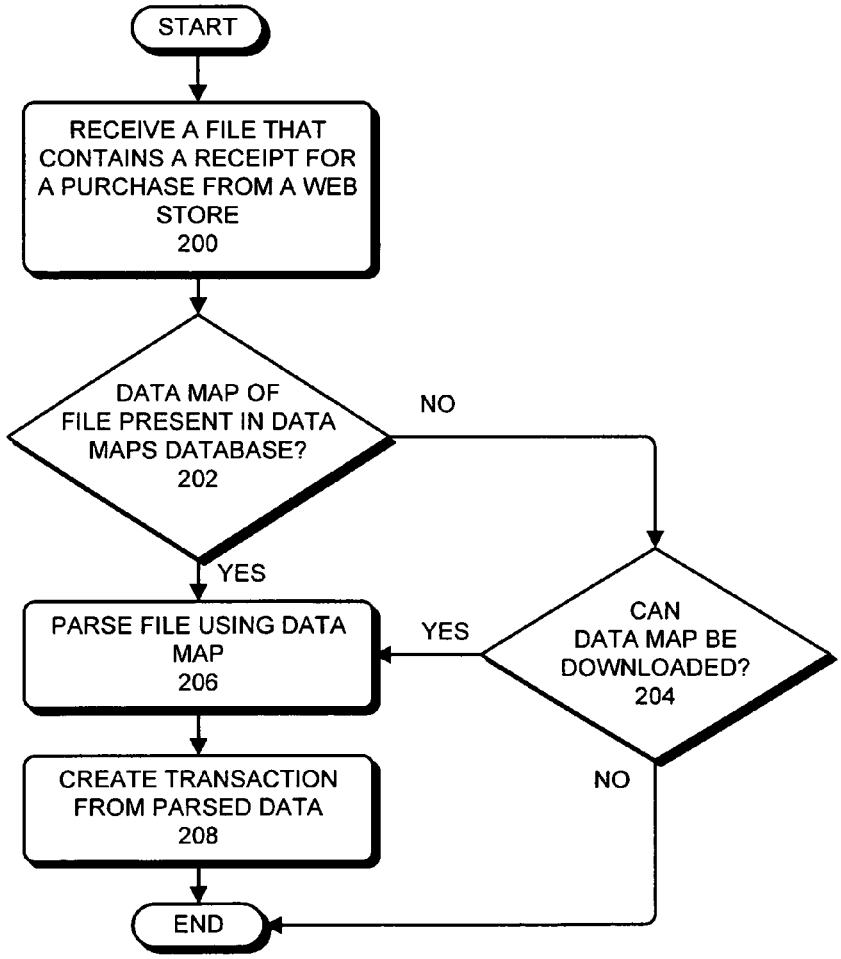
FIG. 2 presents a flowchart illustrating the process of parsing purchase information in a file in accordance with an embodiment of the present invention.

FIG. 2 presents a flowchart illustrating the process of parsing purchase information in a file in accordance with an embodiment of the present invention. The process starts when the financial management receives a file that contains the receipt for a purchase from a web store (step 200). In one embodiment of the present invention, the user enters the identity of the web store that produced the file. In an alternative embodiment, the financial management application determines the source of the file.

Then, according to the web store that produced the file, the financial management application determines if a data map of the file is present in the data maps database (step 202). If the data map is not available in the financial management application's database, the financial management application can attempt to download the data map (step 204) corresponding to the web store via the application updater. If the updater is unable to download a data map for the file, the file cannot be parsed and the process is complete.

Otherwise, the financial management application uses the data map corresponding to the web store to parse the file (step 206). The financial management application then creates a new transaction from the data parsed from the file (step 208).

Visual Import

In one embodiment of the present invention, the financial management application supports a Visual Import. In this embodiment, the user selects data from a file and indicates the type of data selected to the financial management application. The financial management application then imports the data and creates a transaction in the purchase information database. (Note that although we use a browser/web pages for the purposes of illustration, embodiments of the invention work using the same principles on other types of files.)

Figure 3:
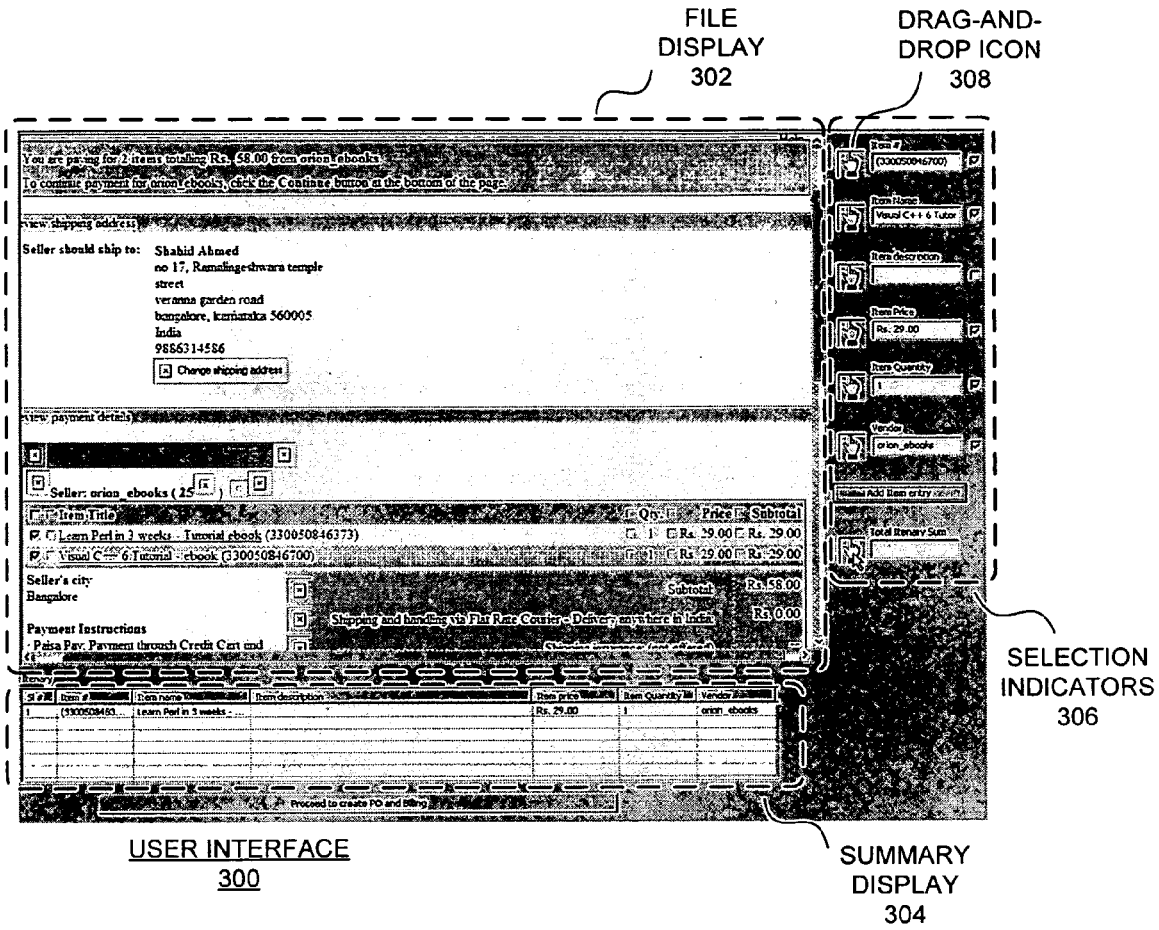
FIG. 3 illustrates an exemplary user interface for a Visual Import in accordance with an embodiment of the present invention.

FIG. 3 illustrates an exemplary user interface 300 for a Visual Import in accordance with an embodiment of the present invention. User interface 300 includes file display 302, summary display 304, and selection indicators 306. File display 302 displays the contents of a file to the user, while summary display 304 and selection indicators 306 facilitate the creation of transactions from the data in the file.

During operation, the user shops from a web store using a browser control hosted within the financial management application. (Alternatively, the user can shop from a web store using a using a browser with an extension.) As the user navigates the web pages in the web store, the web pages are displayed in the file display 302. As shown in FIG. 3, after the user makes a purchase, the financial management application displays the receipt delivered from the web store in file display 302. If the user wishes to input the purchase information into a new transaction, the user can use selection indicators 306 to indicate information in the file display 302 that the user wants to add to a transaction.

In one embodiment of the present invention, in order to facilitate the creation of the transaction, each selection indicator 306 includes a drag-and-drop icon 308. The user drags the drag-and drop icon 308 over a field in the file display 302 and releases the icon. The financial management application detects the information under the dropped icon and places that value in the entry box corresponding to the icon. For example, the user can drag the icon corresponding to the "Item Price" selection indicator over the "29.00" associated with the "Learn Perl in 3 Weeks" entry in file display 302. When the user drops the icon, the financial management application places the "29.00" into the "Item Price" selection indicator.

Note that the user can also manually enter or change a value in an entry box. Hence, the user has the capability to modify any data in the entry boxes before the data is entered into the financial management application.

When the user has placed values in the desired entry boxes, the user instructs the financial management application to create a transaction using the values. The financial management application then creates a transaction and displays the transactions in the summary display 304. If the user is satisfied with the created transaction, the user can instruct the financial management application to store the transaction in the purchase information database.

Unlike the previous parsing technique, this technique works for any file and is independent of any changes made from time to time at a web store's web site. In other words, data mappings are not employed in this embodiment because the user indicates where the data is located and what type of data is being indicated.

Figure 4:
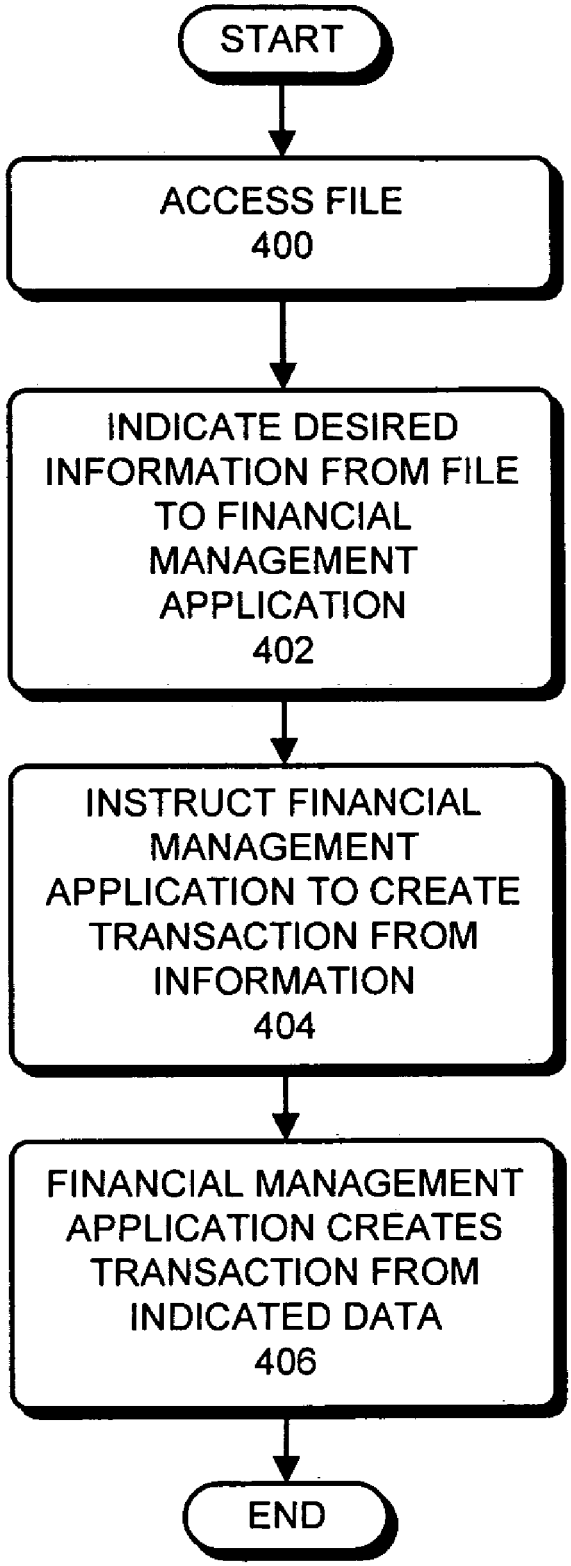
FIG. 4 presents a flowchart illustrating the process of a Visual Import in accordance with an embodiment of the present invention.

FIG. 4 presents a flowchart illustrating the process of a Visual Import in accordance with an embodiment of the present invention. The process starts with the user accessing a file (step 400).

The user then indicates what type of information is contained in the file and how that information is to be incorporated in the transaction (e.g, the item price) (step 402). After the user has indicated this information, the user instructs the financial management application to create a transaction (step 404). In response, the financial management application creates the transaction (step 406).

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A computer-implemented method for entering purchase information into a form in a software application, comprising:

displaying, by computer, an icon in a first area of a display, and a visual representation of a purchase receipt in a second area of the display, wherein the icon corresponds to a data field in the form; and in response to a user dragging and dropping the icon from the first area to a location in the second area, extracting, by computer, information displayed at the location in the second area; and filling, by computer, the extracted information in the data field in the form.

2. The method of claim 1, wherein the visual representation comprises one or more of:

an HTML-formatted file;

an email; and an XML file.

3. The method of claim 1, wherein extracting the information involves:

running a browser within the software application, wherein the software application is signaled in response to the browser accessing a web page that contains the receipt; and upon receiving the signal, using the software application to automatically extract information relating to the purchase from the web page, wherein the software application uses a template to determine where information relating to the purchase is located on the web page.

4. The method of claim 3, wherein the method further comprises automatically updating the template by periodically downloading a current copy of the template from a host.

5. The method of claim 1, wherein extracting the information involves:

running an extension of the software application within a second software application, wherein the extension is signaled in response to the second software application displaying the visual representation; and upon receiving the signal, using the extension to automatically extract information relating to the purchase from the visual representation, wherein the extension uses a template to determine where information relating to the purchase is located within the visual representation.

6. The method of claim 5, wherein the second software application is an email application or a browser.

7. The method of claim 1, wherein the method further comprises modifying the extracted information according to a command from a user, wherein modifying the extracted information involves: changing information in the extracted information, deleting information from the extracted information, or adding information to the extracted information.

8. A non-transitory computer-readable storage medium storing instructions that when executed by a computer cause the computer to perform a method for entering purchase information into a form in a software application, comprising:

displaying an icon in a first area of a display, and a visual representation of a purchase receipt in a second area of a receipt, wherein the icon corresponds to a data field in the form; and in response to a user dragging and dropping the icon from the first area to a location in the second area, extracting information displayed at the location in the second area; and filling the extracted information in the data field in the form.

9. The non-transitory computer-readable storage medium of claim 8, wherein the visual representation comprises one or more of:

an HTML-formatted file;

an email; and an XML file.

10. The non-transitory computer-readable storage medium of claim 8, wherein extracting the information involves:

running a browser within the software application, wherein the software application is signaled in response to the browser accessing a web page that contains the receipt; and upon receiving the signal, using the software application to automatically extract information relating to the purchase from the web page, wherein the software application uses a template to determine where information relating to the purchase is located on the web page.

11. The non-transitory computer-readable storage medium of claim 10, wherein the method further comprises automatically updating the template by periodically downloading a current copy of the template from a host.

12. The non-transitory computer-readable storage medium of claim 8, wherein extracting the information involves:

running an extension of the software application within a second software application, wherein the extension is signaled in response to the second software application displaying the visual representation; and upon receiving the signal, using the extension to automatically extract information relating to the purchase from the visual representation, wherein the extension uses a template to determine where information relating to the purchase is located within the visual representation.

13. The non-transitory computer-readable storage medium of claim 12, wherein the second software application is an email application or a browser.

14. The non-transitory computer-readable storage medium of claim 8, wherein the method further comprises modifying the extracted information according to a command from a user, wherein modifying the extracted information involves: changing information in the extracted information, deleting information from the extracted information, or adding information to the extracted information.

15. An apparatus for entering purchase information into a form in a software application, comprising:

a processor;

a memory coupled to the processor, wherein the memory stores instructions and data for the processor;

a database stored in the memory, wherein the database includes purchase information for the software application; and an execution mechanism coupled to the processor and configured to:

display an icon in a first area of a display, and a visual representation of a purchase receipt in the second area of the display, wherein the icon corresponds to a data field in the form;

extract information displayed at a location in the second area; and fill the extracted information in the data field in the form;

wherein the extraction and the filling are in response to a user dragging and dropping the icon from the first area to the location in the second area.

16. The apparatus of claim 15, wherein the visual representation comprises one or more of:

an HTML-formatted file;

an email; and an XML file.

17. The apparatus of claim 15, wherein the execution mechanism is configured to extract the information by:

running a browser within the software application, wherein the software application is signaled in response to the browser accessing a web page that contains the receipt; and upon receiving the signal, using the software application to automatically extract information relating to the purchase from the web page, wherein the software application uses a template to determine where information relating to the purchase is located on the web page.

18. The apparatus of claim 17, wherein the execution mechanism is configured to automatically update the template by periodically downloading a current copy of the template from a host.

19. The apparatus of claim 15, wherein the execution mechanism is configured to extract the information by:

running an extension of the software application within a second software application, wherein the extension is signaled in response to the second software application displaying the visual representation; and upon receiving the signal, using the extension to automatically extract information relating to the purchase from the visual representation, wherein the extension uses a template to determine where information relating to the purchase is located within the visual representation.

20. The apparatus of claim 19, wherein the execution mechanism is configured so that the second software application is an email application or a browser.

21. The apparatus of claim 15, wherein the execution mechanism is configured to modify the extracted information according to a command from a user, wherein when modifying the extracted information, the execution mechanism is configured to change information in the extracted information, delete information from the extracted information, or add information to the extracted information.

* * * * *